United States Patent [19]

Kuo

[11] Patent Number: 4,808,143

[45] Date of Patent: Feb. 28, 1989

[54] TOY MACHINE GUN

[76] Inventor: Yi Y. Kuo, 9th Fl. Bldg. A, No. 25, Chung Shan N. Road, Sec. 3, Taipei, Taiwan

[21] Appl. No.: 92,108

[22] Filed: Sep. 2, 1987

[51] Int. Cl.[4] ..... A63H 5/04

[52] U.S. Cl. ..... 446/406; 446/473; 446/144

[58] Field of Search ..... 446/406, 407, 405, 473, 446/397, 144, 145, 418, 401, 398

[56] References Cited

U.S. PATENT DOCUMENTS 3,010,718 11/1961 Pearson, Jr. ..... 446/405 X 3,464,152 9/1969 Ryan et al. ..... 446/406

4,626,222 12/1986 Sweet ..... 446/473 X

*Primary Examiner*—Mickey Yu

*Attorney, Agent, or Firm*—Varndell Legal Group

[57] ABSTRACT

An improved toy machine gun is disclosed. The toy gun has a trigger associated with a microswitch. The microswitch engages a rotatable wheel through a reduction gear. A link assembly together with the rotatable wheel provides a reciprocating motion and create a kickback. In addition, the link assembly is arranged to actuate another microswitch which controls an audio circuit board and a speaker for generating a sound mimicking a gun shot.

2 Claims, 5 Drawing Sheets

TOY MACHINE GUN

BACKGROUND OF THE INVENTION

The present invention relates to a toy machine gun and particularly to one which, when in use, can create both a kickback and a gun shot sound so as to make the user feel as though he is shooting a real machine gun.

Conventional toy guns can be classified into three categories as follows:

I. The first type of toy gun merely provides a sound and fails to provide the user with a real gun shooting feeling.

II. The second type of toy gun generates a large explosion sound together with a powder smell by firing gunpowder in the gun, but it is quite dangerous and it may easily cause an accident.

III. The third type of top gun is similar to the second type except that the gun powder is replaced by a toy bullet. Such a toy bullet can be shot out of the toy gun and, therefore, it is also quite dangerous and may easily cause an accident.

It is, therefore, an object of the present invention to obviate and mitigate the drawbacks of the conventional toy guns.

SUMMARY OF THE INVENTION

It is the primary object of the present invention to provide an improved toy machine gun which can create both a kickback and a gun shot sound to satisfy the user's requirements for obtaining a real gun shooting feeling.

It is another object of the present invention to provide an improved toy machine gun which, when in use, is quite safe.

It is a further object of the present invention to provide a toy machine gun which is economic to manufacture.

DETAILED DESCRIPTION OF THE PREFERRED EMBODIMENT

Figure 1:
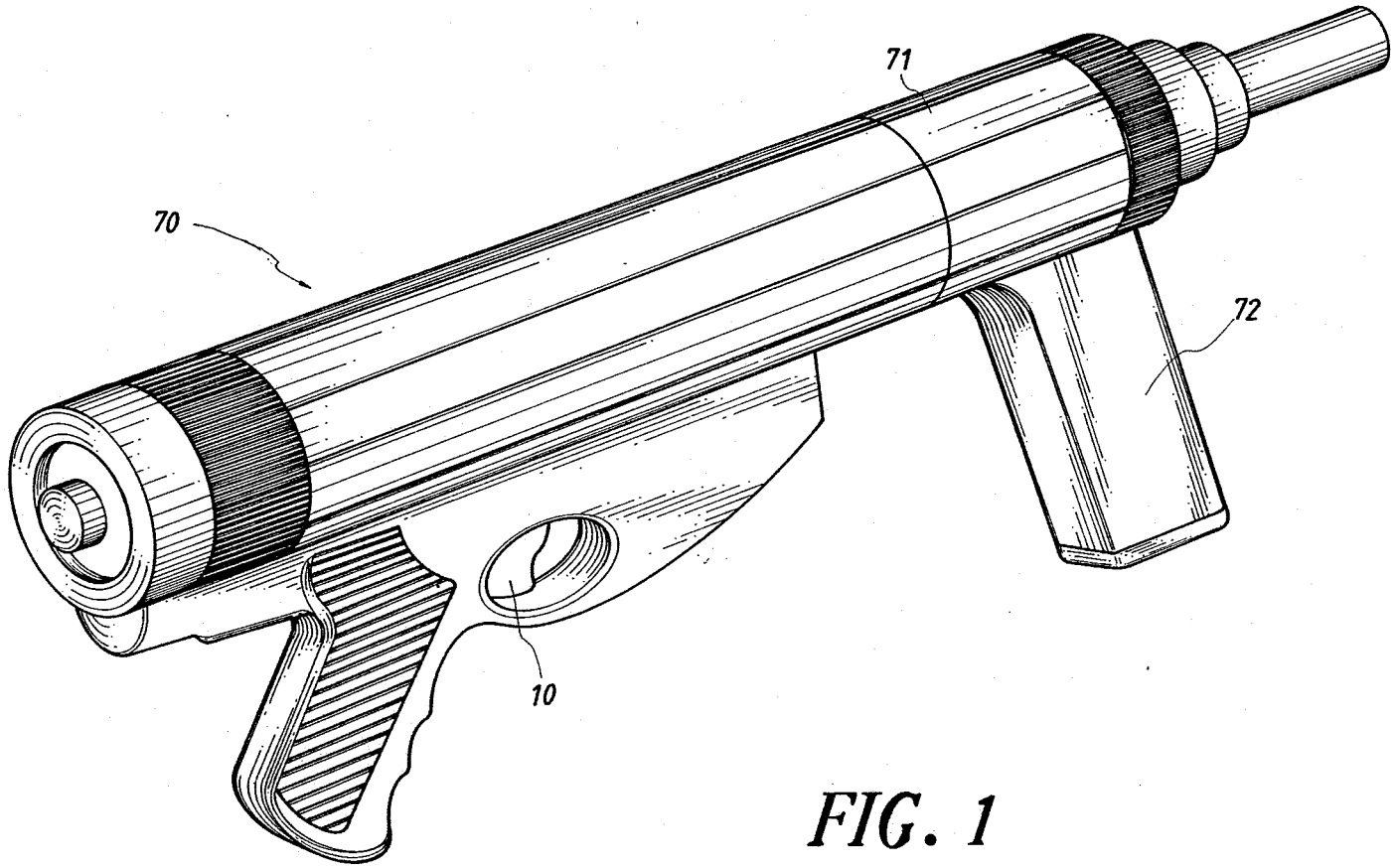
FIG. 1 is a perspective view of a preferred embodiment of the present invention.
Figure 2:
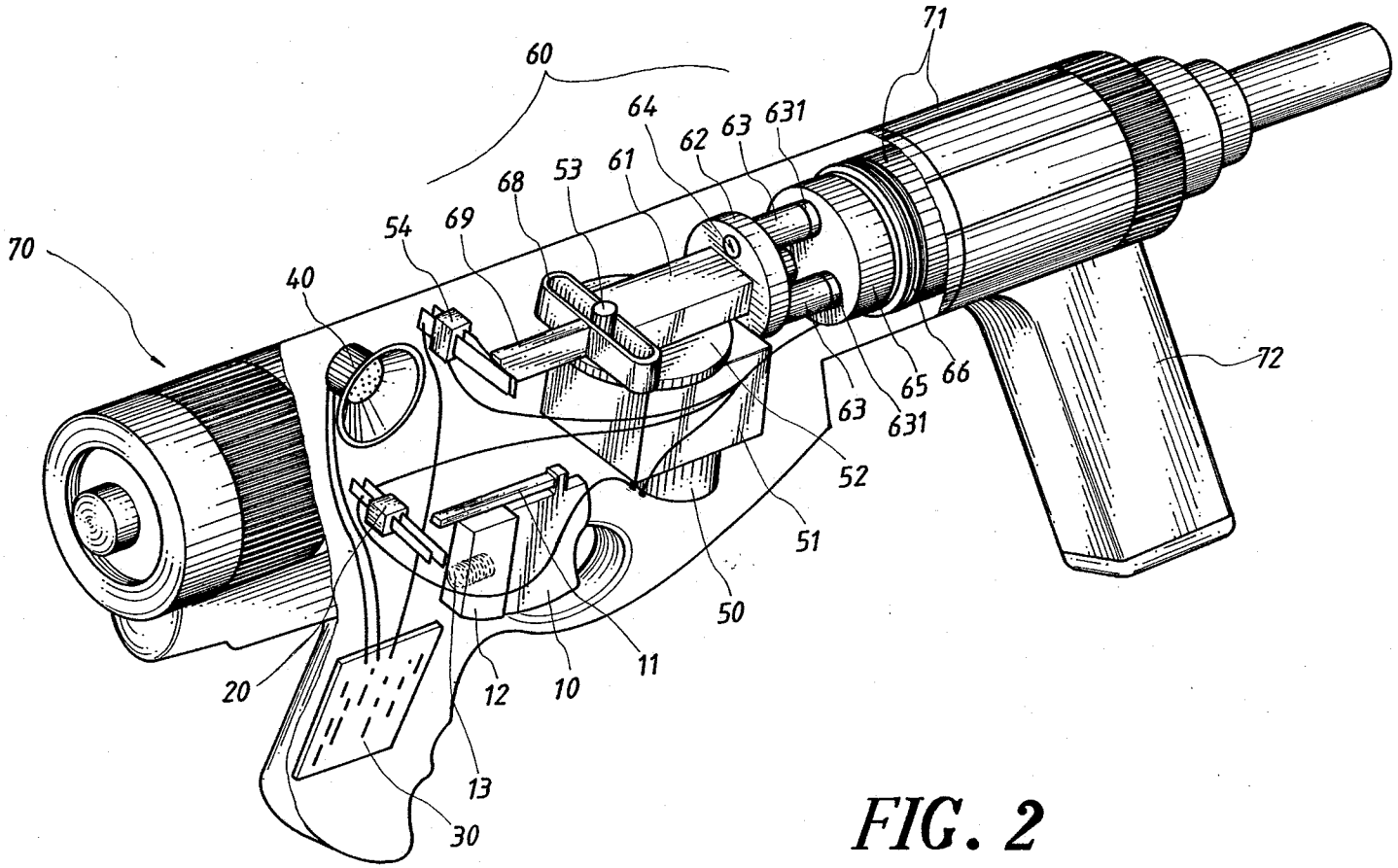
FIG. 2 is a partially cut-away view of the present invention.
Figure 3:
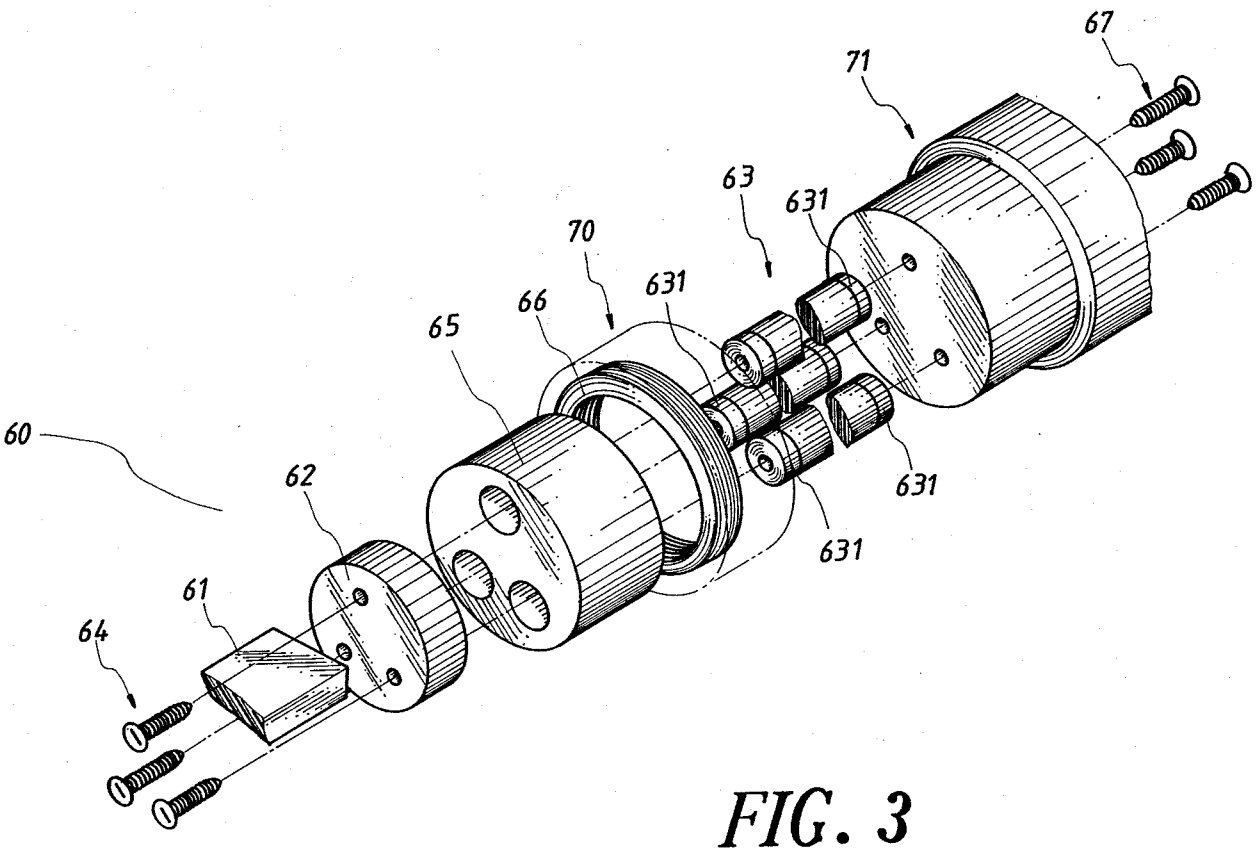
FIG. 3 is an exploded view of a link assembly of the present invention.
Figure 4:
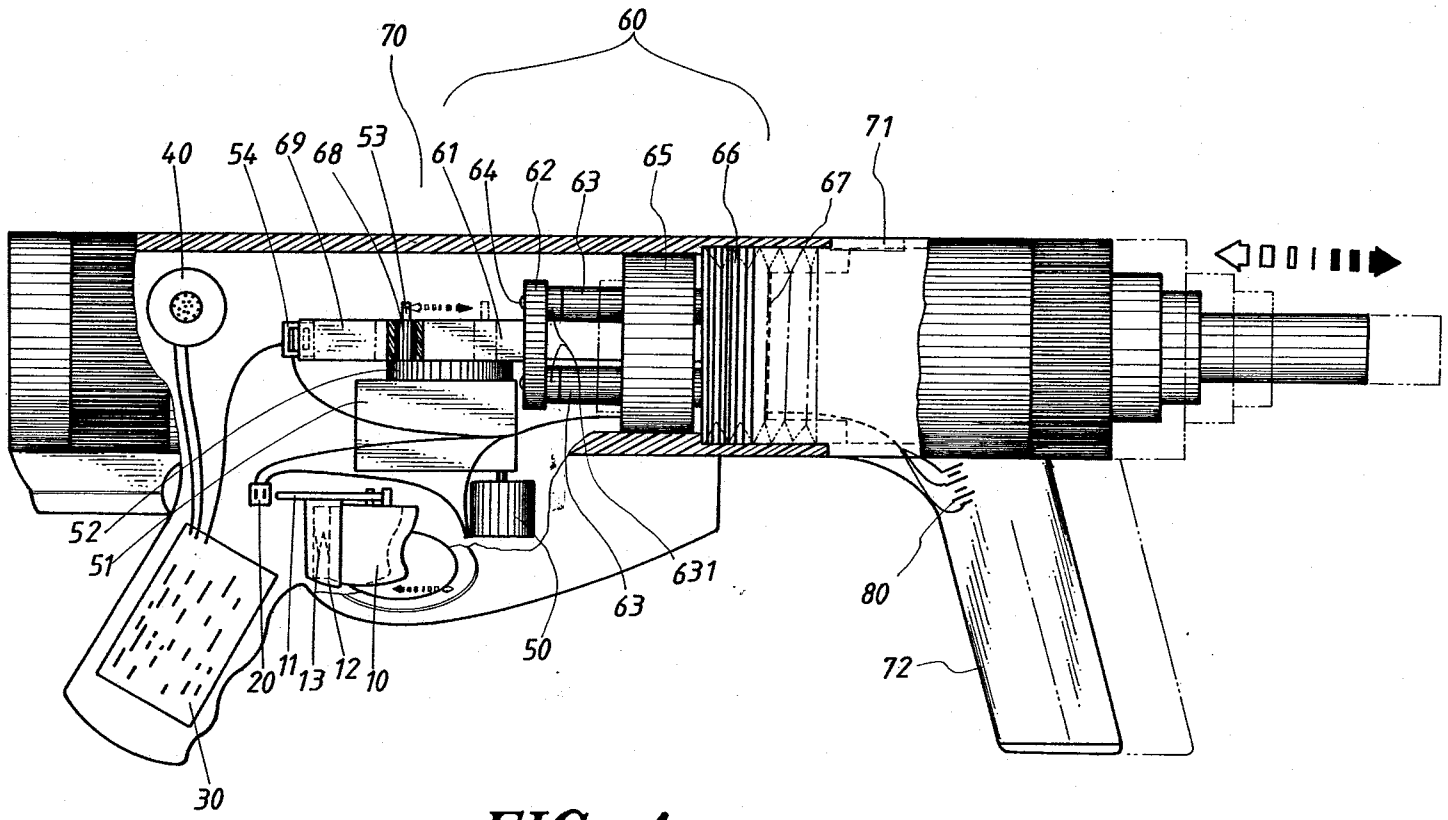
FIG. 4 is a schematic cross-sectional view of the present invention.
Figure 5:
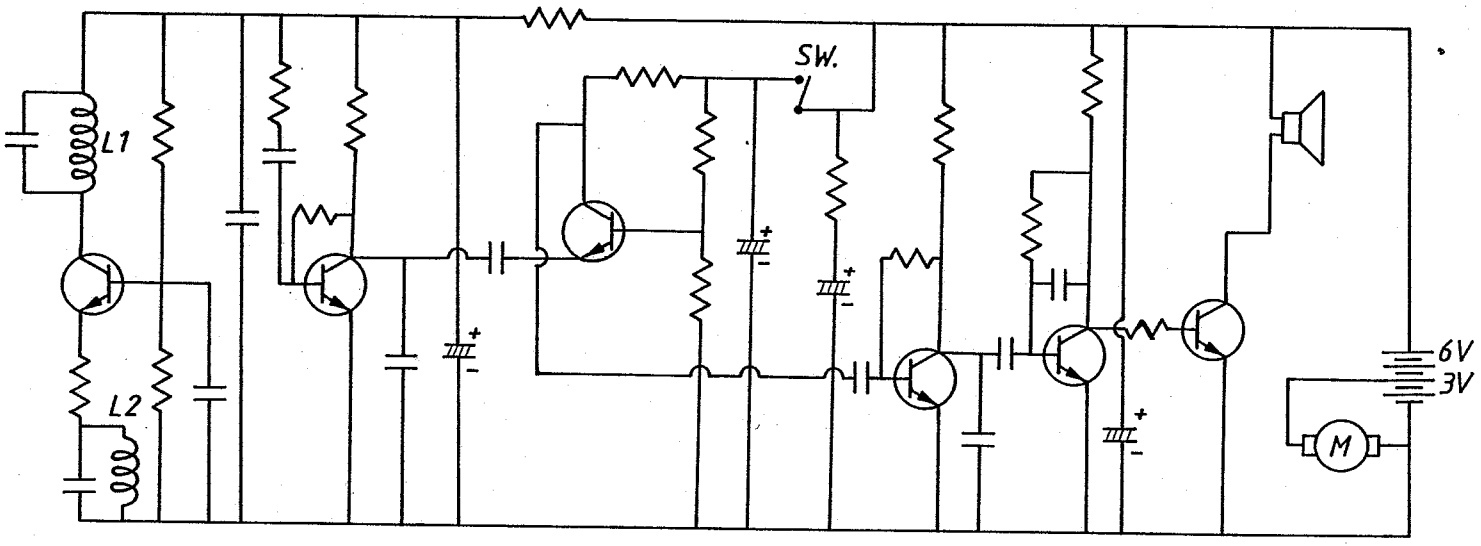
FIG. 5 is an audio circuit diagram of the present invention.

Referring to FIGS. 2 and 3, a preferred embodiment of the present invention comprises a trigger (10) having a trigger arm (11). The trigger (10) is received in a trigger casing (12) which has a spring (13) disposed therein. Both a microswitch (20) and an audio circuit board (30) associated with a speaker (40) are properly located near the rear end of the trigger arm (11). A motor (50) is located near the front end of the trigger arm (11). The motor (50) connects with a reduction gearbox (51) with reduction gears (not shown) disposed therein. An output rotatable wheel (52) with a protruding pole (53) is arranged to connect with the reduction gearbox (51). A link assembly (60) consists of a link arm (61) which is provided at the rear end with a loop member (68) and an arm (69) extending rearwardly from the loop member (68). The loop member (68) is arranged to encircle the protruding pole (53) of the rotatable wheel (52). A microswitch (54) is located near the rear end of the arm (69) of the link arm (61). The link arm (61) is provided at the other end with a plastic piece (62) to which three steel tubes (63) are connected by screws (64). Each of these steel tubes (63) has a steel plug (631) at each end thereof. All three tubes (63) respectively pass through a sleeve (65) and a liner (66), and then said tubes are secured to a head portion (71) by screws (67). The sleeve (65) is secured to a gun body (70). The liner (66) is secured at one end to the gun body (70) and at the other end to the head portion (71). As shown in FIG. 4, a battery (80) is disposed in a front handle (72) of the instant toy gun.

Referring to FIG. 2, when in use, first the trigger (10) is pulled so that the trigger arm (11) actuates the microswitch (20) thereby completing a conductive path constituted by the battery (80) and the motor (50), as shown in FIG. 4. Then, the motor (50) starts to drive the reduction gears (not shown) in the reduction gear box (51). This in turn drives the rotatable wheel (52) together with its protruding pole (53) to rotate. The protruding pole (53), when rotating with the wheel (52), can drive the loop member (68) to more forward. This, in turn, can drive the plastic piece (62), the steel tubes (63) and the head portion (71) to move forward. Similarly, when the loop (68) moves backward, the head portion (71) will move backward accordingly to hit the gun body (70). This can provide the user with a kickback which normally occurs in the real shooting of a gun. However, owing to the presence of the liner (66), the gun body (70) will not be destroyed by the hitting of the head portion (71). Furthermore, when the loop (68) moves backward, the arm (69) is arranged to actuate the microswitch (54), so as to complete a conductive path constituted by the battery (80) and the audio circuit board (30). Under such circumstances, the audio circuit board (30) associated with the speaker (40) can generate a gun shot sound. Finally, the trigger (10) will return to its original position by the aid of the spring (13) in the trigger casing (12).

In view of the above, the instant toy machine gun can advantageously create both a kickback and a gun shot sound. Therefore, it may satisfy the user's requirements for obtaining a real machine gun shooting feeling.

I claim:

1. An improved toy machine gun comprising a trigger, a link assembly and rotating means;

said link assembly having a loop member and a plurality of steel tubes, said loop member having an arm connected to one end thereof and a plastic piece connected to another end thereof; each of said steel tubes having one end secured to said plastic piece by screw means, a portion passing through a sleeve and a liner, and another end secured to a head portion by screw means;

said rotating means including a motor coupled to an output rotatable wheel having a protruding pole thereon, said loop member of said link assembly being arranged to encircle said pole, said trigger including means capable of activating said motor, so that said protruding pole rotates about said output rotatable wheel causing said link assembly together with said head portion to move in a reciprocating motion by action of said protruding pole on said loop member.

2. An improved toy machine gun as claimed in claim 1, including an electrical circuit having a microswitch for opening and closing said electrical circuit, a battery, an audio circuit board capable of generating a sound mimicking a shot of a machine gun, and a speaker; said microswitch being arranged to contact said arm of said link assembly, so that said reciprocating motion of said link assembly causes said microswitch to periodically complete said electrical circuit causing said audio circuit board to generate said sound and pass said sound through said speaker.

* * * * *